US005607519A

United States Patent [19]

Krepak

[11] Patent Number: 5,607,519

[45] Date of Patent: Mar. 4, 1997

[54] PHOTON AND/OR ELECTRON GENERATING POWER CELL

[76] Inventor: John C. Krepak, 1024 Prospect St., Shreveport, La. 71104

[21] Appl. No.: 499,470

[22] Filed: Jul. 7, 1995

[51] Int. Cl.[6] ..... G21H 1/06

[52] U.S. Cl. ..... 136/253; 310/303

[58] Field of Search ..... 136/253; 310/303

[56] References Cited

U.S. PATENT DOCUMENTS 3,497,392 2/1970 Walker ..... 136/253

FOREIGN PATENT DOCUMENTS 1351191 3/1964 France ..... 136/253

*Primary Examiner*—Aaron Weisstuch

[57] ABSTRACT

An impermeable, stainless steel, high chrome content container, with an inside surface coating of photo-voltaic elements comprising PN junctions upon which photons and/or electrons are impinged for conversion to electrons to produce useful electric energy; and containing an ionizing radiation energy source surrounded by an ionizable material to induce the ionizable material to emit a photon and/or electron for deposition on the PN junction elements to convert into electrical energy.

7 Claims, 2 Drawing Sheets

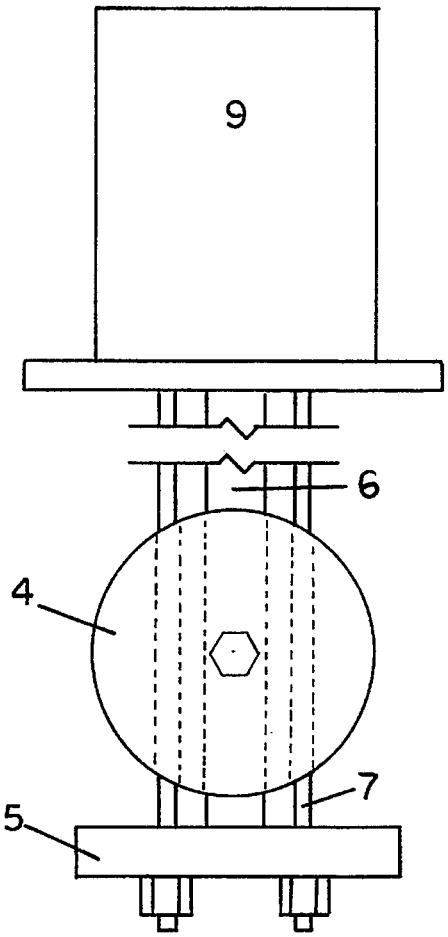
FIG. 2
FIG. 4
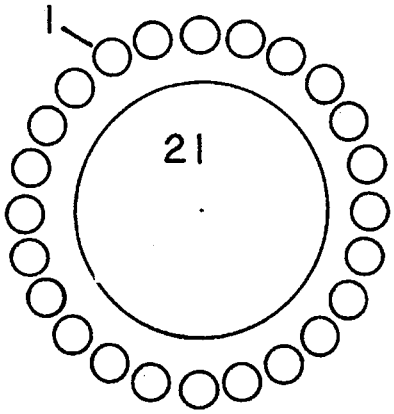
FIG. 3
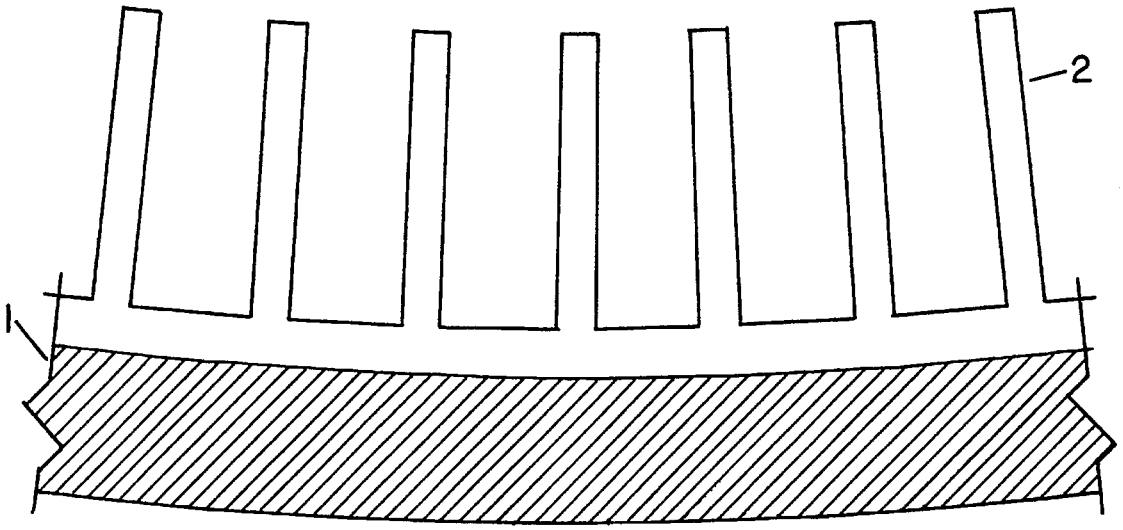

PHOTON AND/OR ELECTRON GENERATING POWER CELL

FIELD OF THE INVENTION

This invention deals with using ionizing gamma and/or other radiation sources to ionize an ionizable material, that produce photons that generate electrons.

BACKGROUND OF THE INVENTION

At the present time electric generators produce direct or alternating electric current by rotating looped wires in a magnetic field or rotating magnetic fields in looped wires. Wind power, water power and mechanical power produced by internal combustion engines turn electric generators to produce electricity. Nuclear power uses heat to boil water to produce steam to turn a turbine that turns an electric generator. Electric output never equals the input horsepower. Solar power uses photons from the sun falling on PN junctions to convert photons with energy of 1.59 electron volts into electrons by providing an electromotive force at the PN junction, allowing electrons to cross thereover.

At the upper edge of the atmosphere a one square meter solar cell has a potential irradiance of 1367 watts per square meter. However, with an efficiency factor of ten percent, the useable energy output is 136.7 watts. At ground level in the middle of July on a clear, cloudless day, during the best sunshine hours, the atmosphere reduces the ground level potential irradiance to 865 watts per square meter. At ten percent efficiency, useable electrical energy output then is 86.5 watts per square meter. In the middle of January, same clear, cloudless day, etc., the atmosphere reduces the ground level potential irradiance to 300 watts per square meter. At ten percent efficiency only 30 watts of electrical energy output is available.

The storage problem created with nuclear waste has become enormous. One of the purposes of this invention is to provide a use for ionizing gamma and/or other radiation source waste. Technology exists for processing this ionizing radiation gamma and/or other source waste into concentrated energy sources of ionizing energy capable of generating a substantial number of photons and/or electrons, using an existing technology that builds solar cells for the space program. An electron generator like this invention could utilize a large percentage of the world's gamma and/or other radiation nuclear waste sitting in holding pools at reactors all over the world. Using the 6 to 7 Mev gamma and/or other radiation source being emitted by a typical nuclear reactor to ionize hydrogen atoms subjected to this ionization will produce a substantial amount of electrical horsepower without turning a single steam-driven generator.

SUMMARY OF THE INVENTION

This invention is comprised of a container capable of storing the smallest size atoms for an unlimited period of time. This container is enclosed in a lead vault to contain radiation energy. The inside surface of this container is covered with photo-voltaic elements, which comprise PN junctions, and which are capable of converting photons and/or electrons into useful electrical energy. Inside the container is an ionizing radiation energy source, surrounded by an ionizable material that can be ionized and induced to emit an ultra-violet photon and/or electron for absorption by a PN junction device to convert to electrons to produce electrical energy.

Because it only requires 8.21 to 13.6 electron volts to ionize, the preferred ionizable material is the hydrogen atom.

This ionizable material, hydrogen is compressed to a density of from 25 to 50 hydrogen atoms per cubic nanometer. A density of 35 hydrogen atoms per cubic nanometer would provide $3.5\times10^{28}$ hydrogen atoms per cubic meter. A single or a plurality of ionizing radiation energy sources of 1.20 Mev energy can produce the Compton effect. Reference: NUCLEAR CHEMISTRY, Theory and Applications by Gregory R. Choppin and Jan Rydberg, pages 282 and 283, explaining the extensive secondary ionization that takes place with a weak bond electron and high energy ionizing gamma and/or other radiation energy source for ionization. A conservative absorption rate of only 240 parts per billion hydrogen atoms will induce $3.5\times10^{20}$ BILLION hydrogen atoms to emit $8.4\times10^{22}$ ultra-violet photons (8.21 ev). This ultra-violet photon has 5 times the 1.59 ev energy level found in the near infra-red photon that reaches ground level. $8.4\times10^{22}$ photons and/or electrons per second would indicate a substantial potential amount of electric horsepower when that number of photons and/or electrons is divided by $4.685\times10^{21}$, the number of electrons per second in one horsepower (746 watts) for a total of 17.9 horsepower. A plurality of high energy sources can be used to make full use of the combined photo-electric effect and the Compton effect with its extensive secondary ionization of hydrogen atoms to raise electrical energy production efficiency levels well above that needed to power electric cars without batteries. Since the hydrogen bond strength is only one-tenth that of a covalent bond, gamma-rays and/or other sources of radiation higher energy, rather than interacting with the field of the whole atoms as in the photo-electric effect, interact with the field of one electron directly. This mode of action is called the Compton effect after its discoverer A. H. COMPTON. In the Compton effect an electron is ejected from an atom while the gamma-ray is deflected with a lower energy. Since the Compton interaction occurs only with the most weakly bound electrons and high energy gamma-rays, the binding energy of the electron in the hydrogen atom is negligible compared to the high energy ionizing radiation source. The scattered gamma-ray may still have sufficient energy to interact further by the Compton effect, the photo-electric effect or pair production; again emission of X-rays, an ionizing source and Auger electron usually accompanies Compton and extensive secondary ionization follows.

BRIEF DESCRIPTION OF THE DRAWINGS

FIG. 1 is a schematic drawing depicting the container that holds an ionizing radiation energy source, surrounded by an ionizable material, with a means to retract the ionizing radiation energy source away from the ionizable material; and the PN junction liner for converting photons and/or electrons into electrical energy; the valves and guages necessary to monitor this power cell and the lead vault to operate the power cell in.

FIG. 2 is a schematic drawing of the power source and the means to retract the ionizing radiation energy source from the immediate proximity of the ionizable material to reduce or stop ionization of the ionizable material.

FIG. 3 is a schematic drawing depicting an option of using an alternative to a relatively smooth lining of the PN junction elements on the inside surface of the container in order to increase the total surface area of the PN junction elements.

FIG. 4 is a schematic drawing depicting the use of this power cell, with or without the internal ionizing radiation energy source, positioned within the influence of gamma-ray and/or other ionizing radiation source being emitted from a typical nuclear reactor to produce supplemental electrical energy.

DESCRIPTION OF THE PREFERRED EMBODIMENTS OF THE INVENTION

Figure 1:
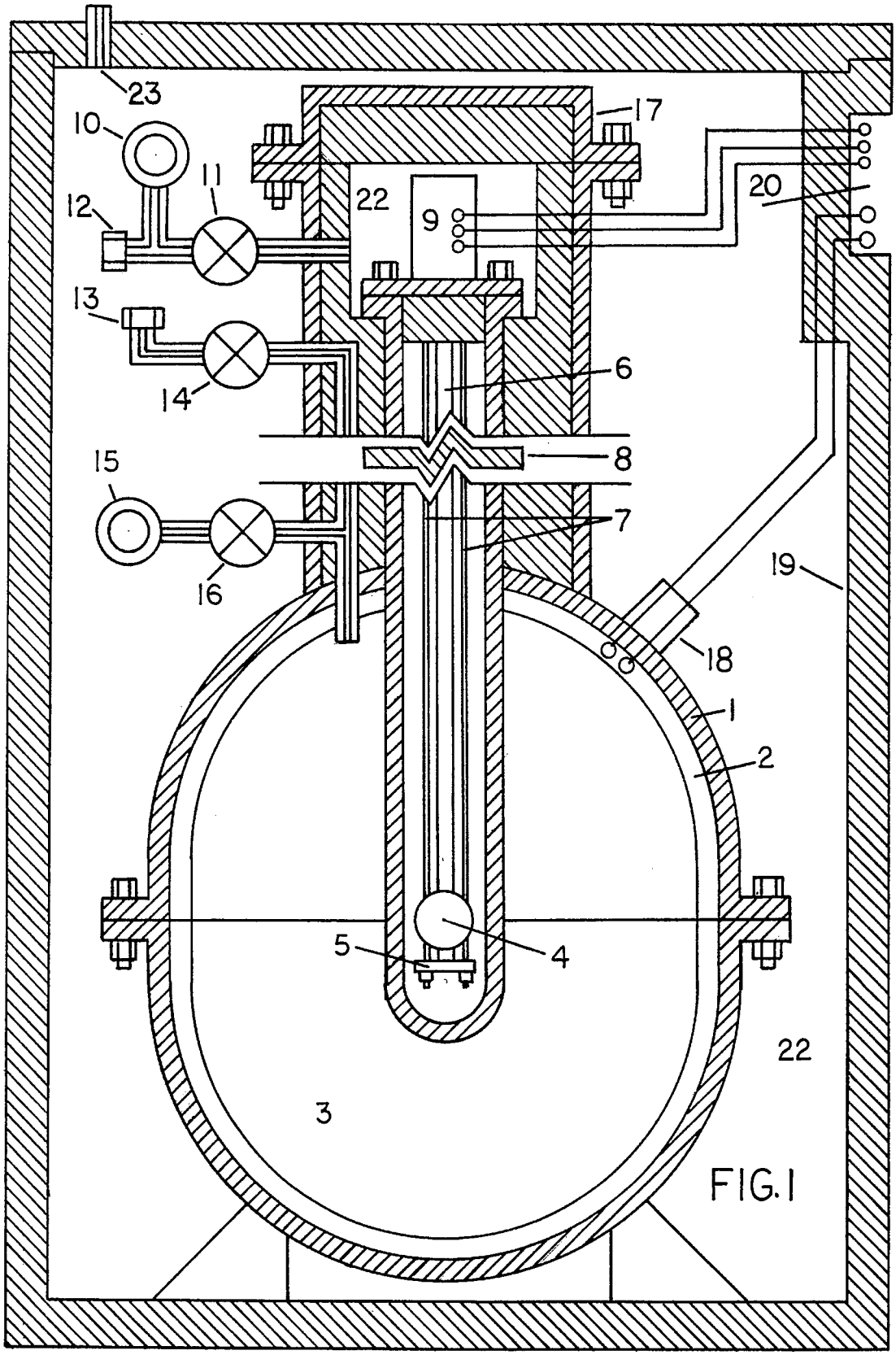

Reffering to FIG. 1, illustrated is a high chrome content stainless steel container 1 of sufficient thickness to store the smallest size atoms under the necessary pressure required to compress hydrogen to a density of from 25 to 50 hydrogen atoms per cubic nanometer. The container 1 has a photo-voltaic lining 2 of PN junction elements, each capable of converting photons and/or electrons into electrical energy, to be transmitted through the power outlet 18, to the power access and control panel 20, located on the outside of the lead vault 19. The preferred but not limited to ionizable material hydrogen atoms 3, compressed to a density of from 25 to 50 hydrogen atoms per cubic nanometer will enable one or a plurality of ionizing radiation energy sources 4, to produce the Compton effect. At a density of 35 hydrogen atoms per cubic nanometer, a cubic meter of hydrogen atoms, would contain $3.5\times10^{29}$ hydrogen atoms 3. To take full advantage of the Compton effect, the distance between the lone electron and its proton in the hydrogen atom should be reduced to achieve greater numbers of electron targets. The pressure guage 10 monitors the pressure of the argon gas surrounding the explosion-proof electric motor 9. The high pressure valve 11 maintains the argon pressure level. Access for refilling the argon gas is provided through filler cap 12. A high pressure valve 14 maintains all the pressure of the ionizable material possible during refilling through the filler cap 13. A high pressure valve 16 maintains internal pressure of the ionizable material hydrogen and protects the pressure guage 15 from the constant high pressure of the hydrogen 3. The access cap 17 with its lead lining protects against radiation escape and provide easy access to the electric motor 9, as well as the ionizing power source without losing any of the ionizable material.

Referring also to FIG. 2, the explosion-proof reversible electric motor 9, surrounded by argon gas 22, at several atmospheres of pressure, turns a worn drive 6, to insert or withdraw the ionization source 4, which is kept from rotating by two guide rods 7, and the ionization source 4 cannot travel beyond a mechanical stop 5.

Referring to FIG. 3, it may be necessary to increase the number of PN junction elements to be able to convert the number of photons and/or electrons enduced by the ionizing radiation sources. The vanes 2 can be comprised of PN elements, with the outer perimeter configured to provide the maximum PN junction contact for photons. These vanes 2 are uniformly positioned around the inside surface of the container 1. The vanes 2 provide an alternative to simply lining the smooth surface of the container 1. The increased PN junction surface area improves efficiency. With this optional configuration, the PN junction elements are directed toward the center of the cell. The ionizable material 3 is in intimate contact with the PN junction elements. There can be no shadows. Photons are being emitted and if reflected are absorbed and converted to electrical power.

Referring to FIG. 4, according to Choppin & Rydberg, page 444 . . . with regard to extracting energy from ionizing gamma radiation emitted from a typical nuclear reactor, the "prompt" emission is about 7 Mev, and the energy from the delayed gamma reaction is about 6 Mev. If this power cell 1, is positioned well within the influence of nuclear reactor gamma-ray ionization energy source 21, with or without the interior gamma ionization energy source 4, the $3.5\times10^{20}$ billion hydrogen atoms, under the Compton effect, can potentially absorb 600 parts per billion hydrogen atoms. Every cubic meter of hydrogen atoms in power cell 1, with a lining of PN junctions 2, ionized by 6 to 7 Mev radiation will supply substantial amounts of electrical energy to each typical nuclear reactor.

In FIG. 1, the inner stainless walls of the tubing welded into the upper half of the container 1, is an integral part of container 1. This makes is possible to access the ionizing radiation energy source without losing the ionizable material, hydrogen.

In FIG. 1, the entire power cell is encased for operation in a lead vault 19, to prevent the escape of ionizing radiation. The space between the power cell 1 and the lead vault 19, can be filled with heavier the air argon gas 22, so that any hydrogen that escapes will float against the underside of the top of the vault 19 to be bled off by a stand-pipe 23, well out of reach of the inhabitants.

In FIG. 1, item 8 indicates a space for a self-powered lead partition that closes itself after the ionizing power source is withdrawn from proximity to the ionizable material to stop the electron generation process during changing of the ionizing radiation source 4.

While the invention has been described in connection with the preferred embodiments, it is not intended to limit the scope of the invention to the particular form set forth, but on the contrary, it is intended to cover such alternatives, modifications and equivalents as may be included within the spirit and scope of the invention as defined in the appended claims.

I claim:

1. A photon and/or electron generating power cell comprising;

(a) a stainless steel and chrome, high pressure container;

(b) a lining of photo-voltaic elements on the inside of said container;

(c) an ionizable material in said container;

(d) at least one ionizing radiation energy source in said container and a lead vault surrounding the high pressure container.

2. A photon and/or electron generating power cell as in claim 1, wherein; the distance between the protons and the electrons of the ionizable material is reduced through compression to increase the number of electrons absorbing energy from the ionizing radiation energy source.

3. A photon and/or electron generating power cell as in claim 1, where-in; the photo-voltaic elements area are configured as a plurality of vanes with PN junction elements on both sides, and extending into the ionizable material.

4. A photon and/or electron generating power cell as in claim 1, including a means to insert or withdraw the at least one ionizing radiation source from the immediate proximity of the ionizable material to either start or stop the ionization process.

5. A photon and/or electron generating power cell as in claim 1, wherein; a sleeve or tubing of the same material as the pressure container is welded into the upper half of this container, permitting the ionizable material to remain intact when the at least one ionizing radiation source needs attention.

6. A photon and/or electron generating power cell as in claim 1, where-in; heavier than air argon gas is maintained around explosion-proof reversible electric motors used to withdraw the at least one radiation energy source, to reduce the likelihood of combustion and/or corrosion; and heavier than air argon gas is maintained between the high pressure container and the lead vault it operates in, to reduce corrosion and the possibility of combustion and in the event the ionizable material becomes a prescence, purge it from the vault.

7. A photon and/or electron generating power cell as in claim 1, where-in the photo-voltaic elements are configured to form a relatively smooth surface lining on the inside surface of the high pressure container.

* * * * *